United States Patent [19]

Sewell et al.

[11] 4,440,162

[45] Apr. 3, 1984

[54] SODA LIME HALF LIFE INDICATOR

[75] Inventors: Richard B. H. Sewell, Victoria; Lannie K. Yee, Saanichton; Robert W. Chappell, Victoria, all of Canada

[73] Assignee: Her Majesty the Queen in right of Canada, Canada

[21] Appl. No.: 276,519

[22] Filed: Jun. 23, 1981

[51] Int. Cl.[3] ..... A62B 7/08

[52] U.S. Cl. ..... 128/202.22; 128/202.26; 55/DIG. 33; 55/DIG. 34; 73/29; 340/540; 340/588; 340/604; 436/39; 436/147

[58] Field of Search ..... 55/270, 274, DIG. 34, 55/DIG. 33; 73/75, 29; 128/202.22, 202.26, 205.12, 205.27, 736; 340/540, 588, 604; 436/39, 147

[56] References Cited

U.S. PATENT DOCUMENTS

| | | | |
|---|---|---|---|
| 3,773,044 | 5/1983 | Wallace | 128/202.22 |
| 4,046,139 | 9/1977 | Horn | 128/736 |
| 4,108,172 | 8/1978 | Moore, Jr. | 128/205.12 |
| 4,146,887 | 3/1979 | Magnante | 128/202.22 |
| 4,151,831 | 5/1979 | Lester | 128/736 |
| 4,273,120 | 6/1981 | Oswell | 128/205.12 |

*Primary Examiner*—Henry J. Recla

*Attorney, Agent, or Firm*—Cushman, Darby & Cushman

[57] ABSTRACT

The invention disclosed is an indicator for monitoring the capacity of a $CO_2$ absorbent to absorb $CO_2$. The indicator is typically used in association with a closed circuit breathing apparatus, including a container for a $CO_2$ absorbent. The indicator comprises temperature sensing means immersed in the absorbent, a temperature to voltage converter for converting a sensed temperature reading to an electrical voltage signal, temperature trend processing means for processing said electrical voltage signal into a selected electrical output signal characteristic of a temperature trend; and display means for converting said selected electrical output signal to a predetermined visual display indicative of the capacity of the $CO_2$ absorbent to absorb $CO_2$.

15 Claims, 5 Drawing Figures

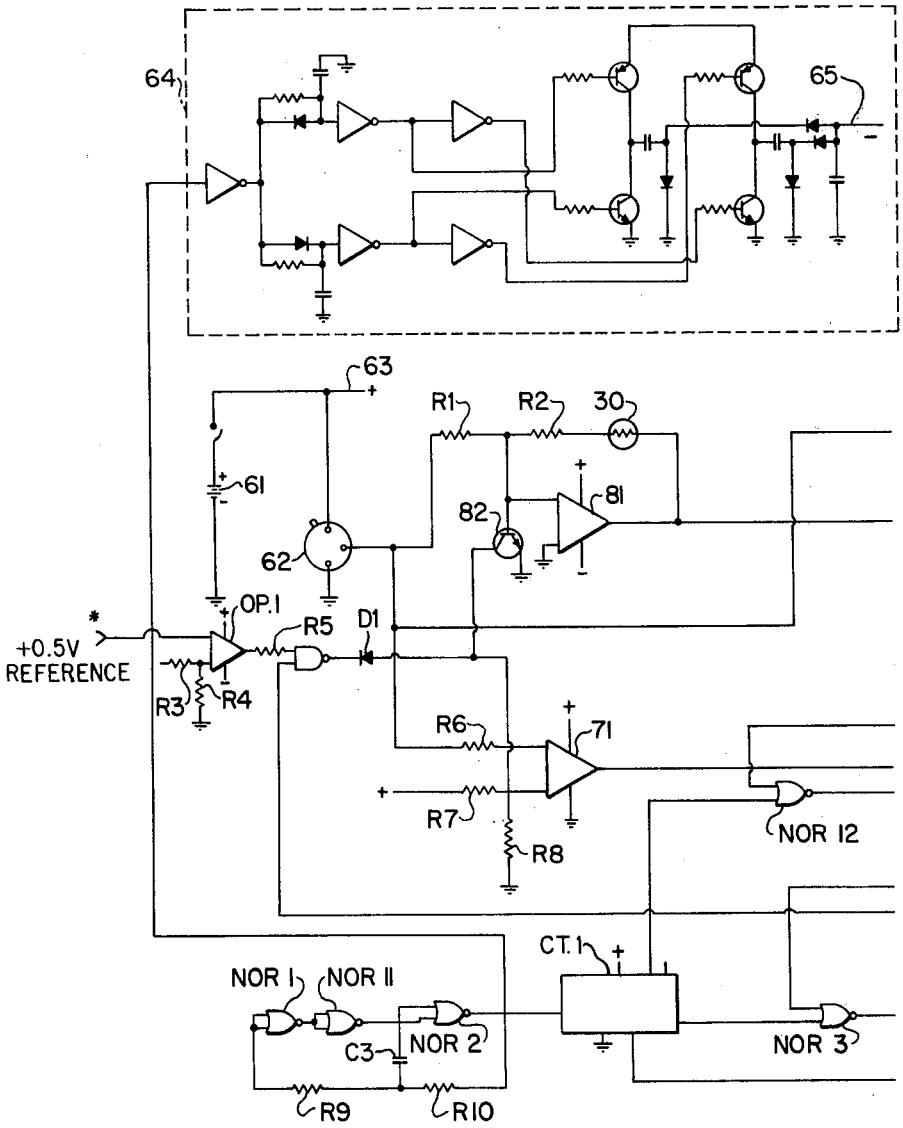
FIG. 4A
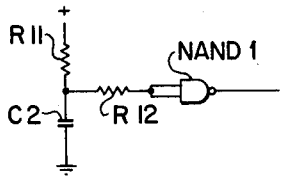

SODA LIME HALF LIFE INDICATOR

This invention relates to the removal of carbon dioxide from a gas stream containing carbon dioxide, by means of a carbon dioxide absorbent, and in particular to a device which monitors the effectiveness of the carbon dioxide absorbent.

Carbon dioxide absorbents e.g. soda lime or other suitable nontoxic alkali and alkaline earth metal hydroxides, are conveniently employed in conjunction with closed circuit breathing apparatus to remove carbon dioxide from the breathing gas e.g. of the type disclosed in Canadian Patent No. 787,693 which issued on June 18, 1978 to Lewis R. Phillips. Unfortunately, the user has no way of determining the percentage of carbon dioxide absorbent which has become exhausted. This problem is of particular significance to divers.

One solution is to have the diver surface after an arbitrarily determined length of time which is known to be "safe". The solution often leads to waste of the carbon dioxide absorbent. Moreover, studies of various batches of the same carbon dioxide absorbent, in this case, soda lime, has shown that the "safe" time can vary substantially. In fact, a recent supply of soda lime employed by divers was causing "blackout" after about 20 minutes of use instead of a normally expected 50 minutes for the same amount of soda lime under the same conditions.

A means for indicating when the effectiveness of a $CO_2$ absorbent is substantially exhausted is disclosed in U.S. Pat. No. 2,270,025 which issued on Jan. 13, 1942 to John R. Ruhoff. This teaching involved the coating of the $CO_2$ absorbent in this case soda lime, with an indicator material which is of one colour at the alkalinity of soda lime, and another colour at the alkalinity of sodium carbonate, as present in soda lime under the conditions of actual use. As the soda lime absorbs $CO_2$ and is converted to carbonate, the colour of the indicator changes to give an indication of the extent of exhaustion of soda lime. Unfortunately, the colour indicator is only useful in some general purpose applications e.g. inside a submarine where the colour change can be easily observed. On the other hand, in a closed circuit breathing apparatus, the $CO_2$ absorbent is enclosed in a canister, and even if the colour change could be monitored it is not sufficiently precise for that purpose. Another obvious problem of such an indicating means is that even if the colour change could be observed by a diver, the observation of a gradual colour change is quite subjective and should the colour change be instantaneous as in the case of some such indicators, a diver could conceivably "blackout" before he reached the surface.

According to the invention, an apparatus for removing $CO_2$ from a gas stream is contemplated, the apparatus comprising a container having a gas inlet and a gas outlet and a $CO_2$ absorbent selected from the group consisting of soda lime and other suitable non-toxic alkali and alkaline earth metal hydroxides disposed in said container, the improvement comprising providing an indicator for monitoring the capacity of the absorbent to absorb $CO_2$, said indicator comprising temperature sensing means immersed in said absorbent for monitoring the temperature profile of the heat generated by the chemical reaction of hydroxide and $CO_2$; temperature to voltage converter means for converting a sensed temperature reading to an electrical voltage signal; temperature trend processing means for processing said electrical voltage signal into a selected electrical output signal characteristic of a temperature trend; and display means for converting said selected electrical output signal to a visual display indicative of the capacity of the $CO_2$ absorbent to absorb $CO_2$.

It has been found that three parameters play major roles in the behaviour of soda lime. These are, particle size, gas flow rate and temperature. The interrelationship of these parameters finds practical expression in which is called the "activity" of soda lime. In addition to "activity" a term "half life" of soda lime will be used hereinafter.

"Activity" is defined as the number of liters of $CO_2$ absorbed by a given weight (700 grams) of soda lime as a 5% $CO_2$–95% $O_2$ gas mixture flows through it at a rate of 32 liters per minute up to the time that 1% $CO_2$ appears in the effluent gas stream. "Half life" is defined as half the time taken to obtain the activity number and indicates when the absorbent's capacity to absorb $CO_2$ has declined by 50%.

Some quantitive information on soda lime and other $CO_2$ absorbents is given in tables I–V which follow.

TABLE I

| RETAINED BY SIEVE NUMBER | PARTICLE SIZE | DRAGER-OXY SODA LIME | CALONA SODA LIME |
|---|---|---|---|
| 6 | 4.78 to 3.36 MM | 16.4% | 0.6% |
| 8 | 3.36 to 2.362 | 71.0% | 60.% |
| 12 | 2.362 to 1.68 | 11.0% | 36.0% |
| 16 | 1.68 to 1.19 | 0.4% | 2.4% |

Table I gives information as to particle size ranges and ratios for two widely used soda limes, Draeger-oxy soda lime and Calona soda lime. It can be clearly seen that there is a marked difference in particle size distributions.

TABLE II

| PARTICLE SIZE | ACTIVITY | | | | | | AVERAGE |
|---|---|---|---|---|---|---|---|
| 4.75 to 3.36 MM | 20.5 | 20.5 | 19 | 19 | 20.5 | 23.6 | 20.4 |
| 3.36 to 2.362 | 46.0 | 47.0 | 46 | 52 | 35 | 47 | 45.5 |
| 2.362 to 1.68 | 55 | 36 | 41 | 44 | 44 | 46 | 44.3 |

Table II shows the very marked relationship between activity and particle size. As one might expect, activity goes up as particle size goes down. The reason of course being the greater surface to mass ratios as particle size decreases.

TABLE III

| FLOW RATE | DRAEGER-OXY SODA LIME ACTIVITY | | | | | AVERAGE |
|---|---|---|---|---|---|---|
| 32.0 l/Min | 63. | 66. | 65 | 65. | 49 | 59.5 |
| 14.75 | 75.6 | 75.6 | 79.0 | | | 76.7 |

Table III shows the major differences in activity which result from differences in flow rate. Draeger-oxy soda lime is the material used for this series of trials.

TABLE IV

| FLOW RATE | LITHIUM HYDROXIDE ACTIVITY | | | | AVERAGE |
|---|---|---|---|---|---|
| 32.0 l/Min | 29.6 | 28.2 | 30. | | 29.3 |
| 14.75 | 47.3 | 46.5 | 45 | 47.3 | 46.5 |

Table IV shows results of a series of trials using lithium hydroxide as the $CO_2$ absorbent. Again it will be noticed that high activity and small particle size are clearly related. It should also be noted that the activity of Draeger-oxy soda lime is much greater than that of lithium hydroxide under comparable flow rate conditions.

TABLE V

| ABSORBENT | ACTIVITY AT 1° C. | 5° C. | 10° C. | 15° C. |
|---|---|---|---|---|
| Lithium Hydroxide | 10.5 | 51.6 | 105 | 102 |
| Draeger-Oxy Soda Lime | 9.0 | 39.0 | 60.5 | 110 |

Table V compares activities of Draeger-oxy soda lime at the temperature shown. Within the temperature ranges shown, it is evident that higher temperature results in higher activity.

It became apparent in the course of work with soda lime that there is a clear temperature cycle through which a charge of soda lime passes in the course of its use by a diver. It is believed that the reason for the temperature cycle is the exothermic reaction first of water vapour with calcium oxide to produce calcium hydroxide and the subsequent reaction of calcium hydroxide with carbon dioxide to produce calcium carbonate and water, according to the following reactions.

$$CaO + H_2O \rightarrow Ca(OH)_2 + 16.0 \text{ Kcal.}$$

$$Ca(OH)_2 + CO_2 \rightarrow CaCO_3 + H_2O + 25.8 \text{ Kcal.}$$

The combined reaction may be written, $$CaO + H_2O + CO_2 \rightarrow CaCo_3 + H_2O + 41.8 \text{ Kcal.}$$

In the drawings which serve to illustrate embodiments of the invention, FIG. 1 is a schematic illustration of a typical closed circuit breathing apparatus including an indicator according to the invention.

FIGS. 4A to 4C illustrate a circuit diagram of one practical embodiment of the invention.

Figure 1:
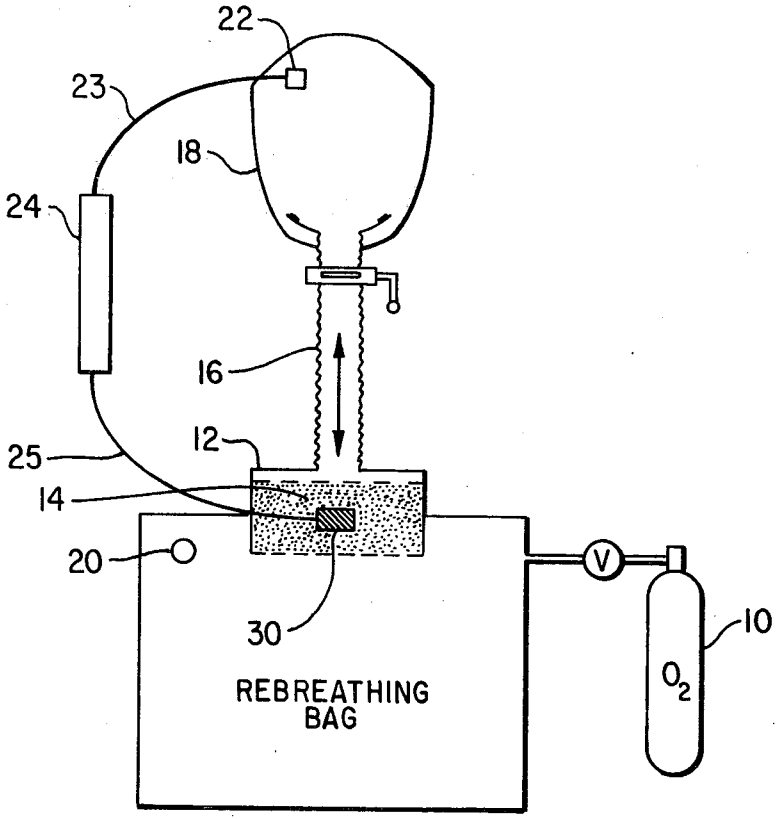

Referring to FIG. 1, the illustrated typical closed circuit breathing apparatus operates as follows. Pure oxygen is fed at a predetermined rate from the oxygen cylinder 10 through the reducing valve $V_{RED}$ into the rebreathing bag (counter-lung). The diver inhales deeply taking oxygen from the counter lung, through the canister 12 containing $CO_2$ absorbent 14, through the flexible tubing 16 and face mask 18 and finally to his lungs. The diver then exhales deeply to drive the respired gases over the same path, the $CO_2$ absorbent removing the $CO_2$ produced by the body. The blow-off valve 20 provides for pressure equalization when the diver is ascending.

Temperature sensing means 30, e.g. a suitable thermistor, (a thermocouple could also be used) is located within the cannister 12, immersed in the $CO_2$ absorbent 14, typically soda lime, in an area of maximum heat concentration and minimum heat loss. The preferred location is basically the centre of the container.

Figure 2:
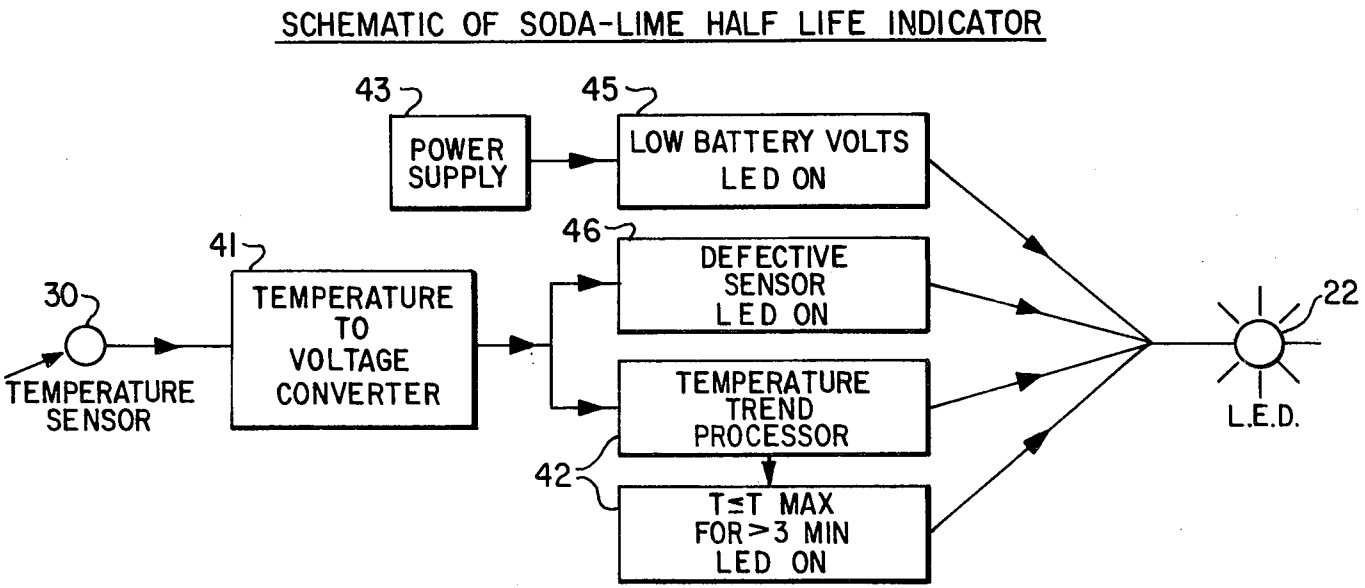
FIG. 2 is a schematic illustration of a soda lime half life indicator according to the present invention which is employed in conjunction with a closed circuit breathing apparatus.

FIG. 2 is a simplified schematic illustration of a device according to the invention. It will be seen that a temperature sensing means serves to monitor a temperature trend profile in the container 12 resulting from the exothermic chemical reaction occuring within the container. The temperature trend profile will be discussed in more detail hereinafter.

Information from the temperature sensor 30 is fed to a temperature to voltage converter 41 which converts the sensed temperature reading to an electrical voltage signal.

The electrical voltage signal is then fed to temperature trend processing means 42 which processes the input signal into one of four different selected output signals respectively indicative of the effectiveness of the $CO_2$ absorbent i.e. its capacity to absorb $CO_2$.

The temperature trend processing means 42 monitors the state of the soda lime, by determining the rate of change of its temperature, and direction of this change (i.e. if the temperature is increasing or decreasing). The conditions present in the soda lime canister 12 are conveniently visually represented by a light emitting dioide (LED) 22, located in the diver's face mask 18. The LED 22 is mounted near the outer edge of the viewing window so as not to hinder the diver's normal vision. The state of the LED when located in this position can be monitored by peripheral vision rather than requiring direct vision.

These four different selected output signals are:

(a) when the temperature of soda lime is increasing, the LED blinks rapidly;

(b) when temperature of the soda lime is constant, the LED blinks once every ten seconds;

(c) when temperature of the soda lime is decreasing, the LED blinks once every second; and (d) when prevailing temperature of the soda lime is less than or equal to the highest temperature attained, for more than three minutes, the LED is on continuously. The LED will remain on even if the temperature were to exceed the previous maximum. Reinitialization can only be accomplished by turning the power off, then on again.

Additional safety features are provided:

(a) should the thermistor become shorted or open due to mechanical failure or the ingress of sea water into the canister, the LED will come on after three minutes;

(b) should the d.c. battery supply voltage be too low for proper circuitry operation, the LED will immediately turn on.

The electronics, including the temperature to voltage converting means 41, the temperature trend processing means 42 and dc power supply 43 are located in a brass pressure case 24, 245 mm. long and 45 mm. in diameter. A waterproof switch on one end of this case turns the system on and off. Two electrically conducting cables, one 23 to the LED 22 and one 25 to the thermistor 30 (e.g. a YSI No. 44105) come into the pressure case 24 through waterproof seals. The pressure case is secured with a rope to a convenient spot on the front of the diver's clearance diving and breathing apparatus.

FIG. 2 also shows a battery voltage monitor unit 45 and a sensor monitor unit 46. The function of the battery voltage monitor 45 is to detect when the battery voltage falls below a predetermined value, and then to energise the LED 22 continuously to indicate a "danger" situation. The sensor monitor unit 46 is sensitive to the output from the temperature-to-voltage converter 41, and should that output fall outside permissible limits (indicating a probable sensor failure), energizes the LED 22 continuously to indicate a "danger" situation.

Figure 3:
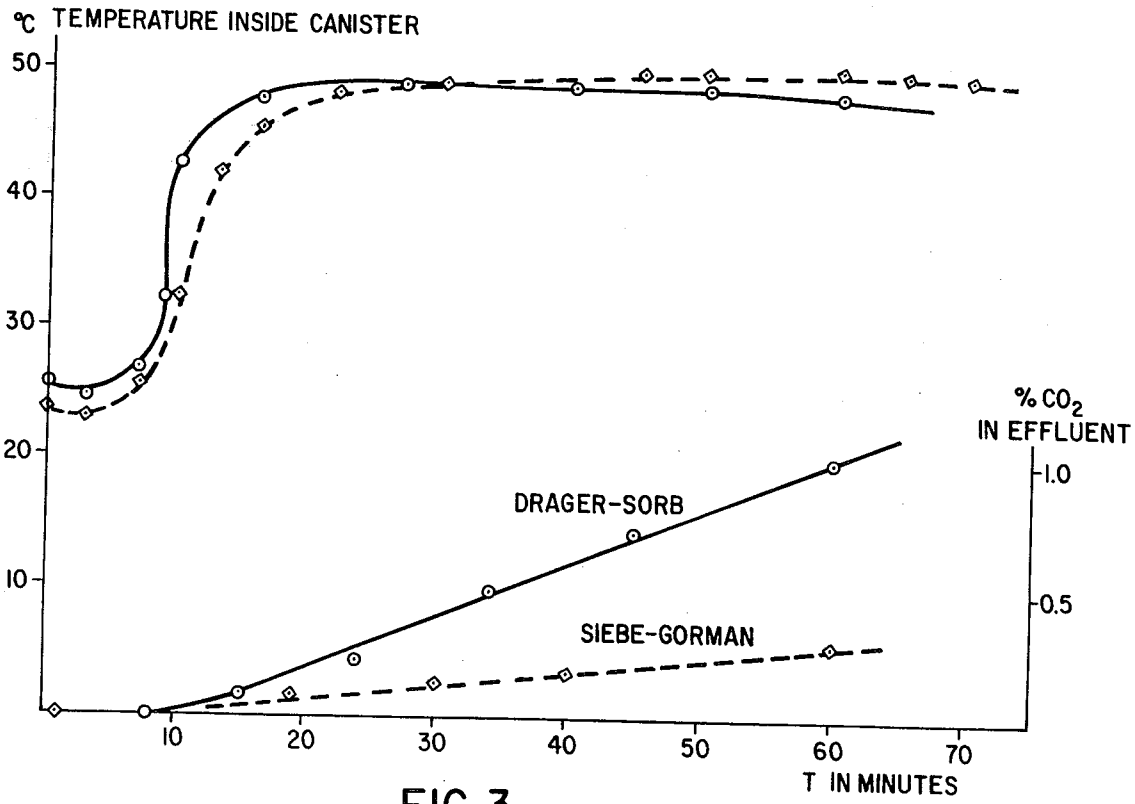
FIG. 3 is a graph illustrating the temperature cycles occurring inside the $CO_2$ absorbent containing canister of the closed circuit breathing apparatus.

FIG. 3 is a graph illustrating the temperature profile of the exothermic reaction for two different $CO_2$ absorbents. It should be mentioned that the temperature cycles shown were obtained in the laboratory with a one way flow of 5% $CO_2$–95% $O_2$ gas mixture. In actual use, the gas flow is of course tied directly to the divers breathing cycle.

It will be seen in the graph that the temperature rises rapidly at first and begins to level of after about 20 minutes of use. The temperature then remains for a time (depending upon the type of $CO_2$ absorbent employed) and then begins to fall off. The "half-life" is reached as the temperature begins to fall off and the diver should note, at this point, 50% of his life support system has been expended.

Figure 4B:
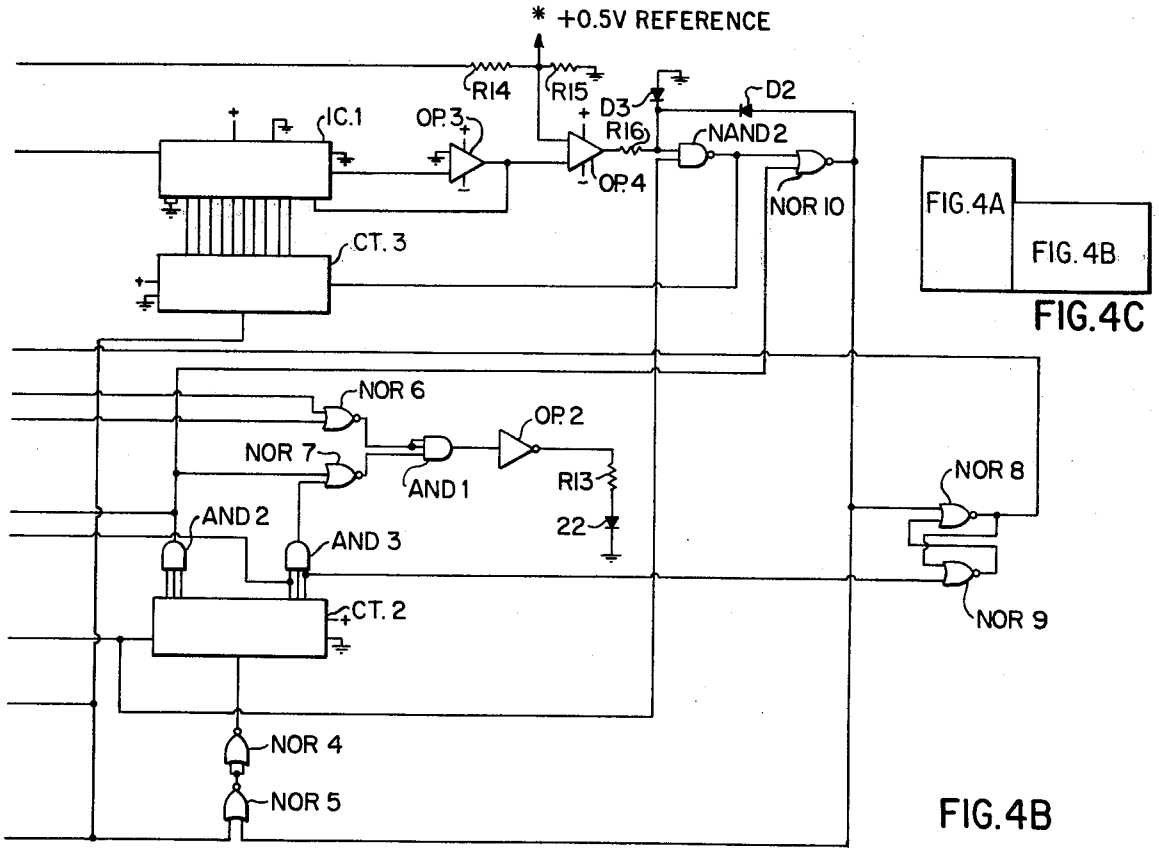

It will be appreciated by those skilled in this art that FIG. 2 is schematic only, and that the electrical circuit must include other components. An example is the need to isolate from one another the various inputs to the LED 22. FIG. 4 is a complete circuit diagram showing one way in which the arrangement of FIG. 2 can be realized in practice. The following list identifies the components shown in FIG. 4.

REFERENCE DESCRIPTION

| NUMERAL | |
|---|---|
| 22 | THERMISTOR YSI No. 44105 |
| 30 | LIGHT EMITTING DIODE |
| 43 | DC POWER SUPPLY INCLUDING<br>61 9 VOLT BATTERY<br>62 VOLTAGE REFERENCE AD 580<br>63 POSITIVE VOLTAGE OUTPUT AT +9 VOLTS<br>64 CIRCUIT TO PROVIDE −9 VOLTS POWER SUPPLY (HEX, INVERTER CD 4049)<br>65 NEGATIVE VOLTAGE OUTPUT AT −9 VOLTS |
| 45 | BATTERY VOLTAGE MONITOR INCLUDING<br>71 OPERATIONAL AMPLIFIER 1A 741 |
| 46 | SENSOR MONITOR UNIT INCLUDING<br>81 OPERATIONAL AMPLIFIER 1B 741<br>82 TRANSISTOR 2N3417 |

| MISCELLANEOUS | | |
|---|---|---|
| RESISTORS | R1 392 OHMS | 1% ACCURACY |
| | R2 1K OHMS | |
| | R3 12K OHMS | |
| | R4 274K OHMS | |
| | R5 100K OHMS | |
| | R6 10K OHMS | |
| | R7 100K OHMS | 1% ACCURACY |
| | R8 68.1K OHMS | 1% ACCURACY |
| | R9 121K OHMS | 1% ACCURACY |
| | R10 47.5K OHMS | 1% ACCURACY |
| | R11 470K OHMS | |
| | R12 10K OHMS | |
| | R13 1.2K OHMS | |
| | R14 39.2K OHMS | 1% ACCURACY |
| | R15 10K OHMS | 1% ACCURACY |
| | R16 100K OHMS | |
| CAPACITORS | | |
| C1 | 0.0019 MFD | |
| C2 | 1 MFD RED CAP | |
| C3 | 0.0019 MFD | |
| OPERATIONAL AMPLIFIERS | | |
| OP.1 | A741 | |
| OP.2 | 1A741 | |
| OP.3 | 1A741 | |
| OP.4 | 1A741 | |

-continued

| | | |
|---|---|---|
| COUNTERS | | |
| | CT.1 | CD 4020 |
| | CT.2 | CD 4020 |
| | CT.3 | UP COUNTER CD 4040 |
| DIODES | | |
| | D1 | HS 1012 |
| | D2 | HS 1012 |
| | D3 | HS 1012 |
| INTEGRATED CIRCUITS | | |
| | 1C.1 | 10-BIT MULTIPLYING D/A AD 7521 |
| GATES | | |
| NAND | 1 | |
| | 2 | Quad 2-INPUT CD 4011 |
| NOR | 1 | QUAD 2 INPUT CD 4001 (3 DEVICES) |
| | 2 | |
| | 3 | |
| | 4 | |
| | 5 | |
| | 6 | |
| | 7 | |
| | 8 | |
| | 9 | |
| | 10 | |
| | 11 | |
| | 12 | |
| AND | 1 | TRIPLE 3-INPUT CD 4073 |
| | 2 | |
| | 3 | |

The positive and negative outputs 63 and 65 of the d.c. power supply are each applied to a number of points, indicated in FIG. 4 respectively by positive (+) and negative (−).

The device according to the invention has been specifically described in relation to its use with soda lime as the $CO_2$ absorbent. It will be appreciated by those skilled in the art that the device would be equally operative with other $CO_2$ absorbents which result in a similar temperature change profile within the cannister containing the $CO_2$ absorbent. Accordingly, the preferred embodiment described above is to be considered as illustrative and by no means restrictive.

The embodiments of the invention in which an exclusive property or privilege is claimed and defined as follows:

1. In an apparatus for removing $CO_2$ from a gas stream, said apparatus comprising a container having a gas inlet and a gas outlet and a $CO_2$ absorbent selected from the group consisting of soda lime and other suitable non-toxic alkali and alkaline earth metal hydroxides disposed in said container which produces an exothermic reaction when said gas stream is passed therethrough, the improvement comprising:

an indicator for monitoring the capacity of the absorbent to absorb $CO_2$, said indicator comprising, temperature sensing means immersed in said absorbent for sensing the temperature of the temperature cycle of the heat generated by the chemical reaction of the hydroxide and $CO_2$, said temperature cycle including a rise, a levelling off and fall in temperature;

temperature to voltage converter means for converting said sensed temperature to an electrical voltage signal;

temperature trend processing means for processing said electrical voltage signal into a selected electrical output signal characteristic of said rising, levelling off and falling temperature trend and indicative of the present effectiveness of the $CO_2$ absorbent; and display means for converting said selected electrical output signal to a predetermined visual display indicative a first indication of said rising, a second indication of said levellng off and a third indication of said falling temperature and wherein each said first, second and third indications being visually unique and materially different from one another and thereby indicating the capacity of the $CO_2$ absorbent to absorb $CO_2$.

2. Apparatus according to claim 1, wherein the temperature sensing means is a thermistor.

3. Apparatus according to claim 2, wherein the display means is a light emitting diode.

4. Apparatus according to claim 3, wherein the $CO_2$ absorbent is soda lime.

5. Apparatus according to claim 1, including d.c. power supply means and monitor circuit means electrically associated with said d.c. power supply and said display means, for detecting when the power supply voltage falls below a set value and then to energize the display means to exhibit a predetermined visual display.

6. Apparatus according to claim 1, 3 or 5, including sensor monitor circuit means electrically associated with said temperature-to-voltage converter and said display means, for monitoring the output signal from said temperature-to-voltage converter and when said output signal falls outside set permissible limits, energizes the display means to exhibit a predetermined visual display.

7. In a closed circuit underwater breathing apparatus, comprising a breathing tube through which a diver may inhale and exhale breathing gas;

a re-breathing bag;

a canister containing a $CO_2$ absorbent selected from the group consisting of soda lime and other suitable non-toxic alkali and alkaline earth metal hydroxides, disposed between said breathing tube and said re-breathing bag, such that fluid communication from said re-breathing bag to said breathing tube is achieved through said cannister wherein an exothermic reaction occurs when exhaled gas is passed therethrough;

inlet means in said re-breathing bag;

a breathing gas reservoir;

gas conduit means for fluid communication between said inlet means and said breathing gas reservoir;

one-way valve means in said gas conduit means to permit breathing as flow from said breathing gas reservoir to said re-breathing bag;

blow-off valve means connected with said re-breathing bag to permit pressure equalization, the inprovement comprising providing an indicator comprising;

temperature sensing means immersed in said absorbent for sensing the temperature of the temperature cycle of the heat generated by the chemical reaction of the hydroxide and $CO_2$, said temperature cycle including a rise, a levelling off and a fall in temperature;

temperature to voltage converter means for converting said sensed temperature to an electrical voltage signal;

temperature trend processing means for processing said electrical voltage signal into a selected electrical output signal characteristic of said rising, levelling off and falling temperature trend and indicative of the present effectiveness of the $CO_2$ absorbent; and display means for converting said selected electrical output signal to a predetermined visual display indicative of a first indication of said rising, a second indication of said levelling off and a third indication of said falling temperature and wherein each said first, second and third indications being visually unique and materially different from one another and thereby indicating the capacity of the $CO_2$ absorbent to absorb $CO_2$.

8. Apparatus according to claim 7, wherein said temperature sensing means is a thermistor.

9. Apparatus according to claim 8, wherein said temperature to voltage converter and said temperature trend processing means are disposed in a water-tight container, including water-tight electrical connections from said thermistor to said temperature to voltage converter and from said temperature trend processing means to said display means.

10. Apparatus according to claim 9, wherein said display means is a light-emitting diode located in the diver's face mask.

11. Apparatus according to claim 8, wherein the display means is a light emitting diode.

12. Apparatus according to claim 11, wherein the $CO_2$ absorbent is soda lime.

13. Apparatus according to claim 12, including d.c. power supply means and monitor circuit means electrically associated with said d.c. power supply and said display means, for detecting when the power supply voltage falls below a set value and then to energize the display means to exhibit a predetermined visual display.

14. Apparatus according to claim 13, including sensor monitor circuit means electrically associated with said temperature-to-voltage converter and said display means, for monitoring the output signal from said temperature-to-voltage converter and when said output signal falls outside set permissible limits, energizes the display means to exhibit a predetermined visual display.

15. Apparatus according to claim 1 or 7, wherein the $CO_2$ absorbent is soda lime of an average particle diameter of 1.68–3.36 m.m.

* * * * *